US005960498A

United States Patent [19]

Nabors et al.

[11] Patent Number: 5,960,498

[45] Date of Patent: Oct. 5, 1999

[54] FOLDABLE TOOL WITH REMOVABLE TOOL CARTRIDGES

[75] Inventors: William Nabors; Debra S. Yates, both of Wichita; David H. Linnebur, Derby; Jon Rodriguez, Rose Hill; Andrew Hill, Wichita, all of Kans.

[73] Assignee: The Coleman Company, Inc., Wachita, Kans.

[21] Appl. No.: 08/897,123

[22] Filed: Jul. 18, 1997

[51] Int. Cl.[6] ..... B25B 7/22

[52] U.S. Cl. ..... 7/128; 7/118

[58] Field of Search ..... 7/118, 127, 128, 7/129, 158, 168, 167; 81/177.4, 177.6, 490

[56] References Cited

U.S. PATENT DOCUMENTS

| | | | |
|---|---|---|---|
| 4,238,862 | 12/1980 | Leatherman | 7/128 |
| 4,744,272 | 5/1988 | Leatherman . | |
| 4,854,045 | 8/1989 | Schaub . | |
| 5,033,140 | 7/1991 | Chen . | |
| 5,142,721 | 9/1992 | Sessions et al. . | |
| 5,251,353 | 10/1993 | Lin . | |
| 5,581,834 | 12/1996 | Collins . | |

FOREIGN PATENT DOCUMENTS

| | | |
|---|---|---|
| 422079 | 6/1947 | Italy . |
| 78928 | 9/1918 | Switzerland . |
| 140193 | 8/1930 | Switzerland . |

OTHER PUBLICATIONS

Trademark Application S.N. 75–090,175.
Trademark Application S.N. 75–090,176.
Schrade Tough Tool Owner's Manual (date not known).

*Primary Examiner*—Timothy V. Eley
*Assistant Examiner*—Sinclair Skinner
*Attorney, Agent, or Firm*—Fitzpatrick, Cella, Harper & Scinto

[57] ABSTRACT

A foldable multi-purpose tool includes a pair of jaws and a pair of folding handles and is capable of accepting removable cartridges. In the extended position, the handles operate the jaws. Each removable cartridge contains a number of relatively small tool blades that are preferably selected by functional categories. Various cartridge hold-down and removal mechanisms are also provided.

30 Claims, 5 Drawing Sheets

FOLDABLE TOOL WITH REMOVABLE TOOL CARTRIDGES

BACKGROUND OF THE INVENTION

The present invention relates to the field of multi-purpose hand tools. More specifically, the present invention relates to a folding multi-purpose tool and a series of interchangeable tool cartridges that interfit with the tool. By selecting the desired cartridge, a user can customize the tool for an intended task. The main portion of the tool includes a pair of gripping jaws and a pair of handles. The cartridges contain various assortments of tools and can be inserted into one or the other handle.

DESCRIPTION OF RELATED ART

Multi-purposes tools (MPTs) have been available for some time. Generally, by combining a number of tools into a single unit, MPTs can reduce the number of individual tools that a user must carry to perform a particular task and reduce the chance of loosing a tool.

U.S. Pat. No. 4,744,272 to Leatherman describes a foldable pair of pliers with a pair of jaws and a pair of handles. When the tool is opened, the handles operate the jaws. When the tool is folded, the jaws nest inside the handles in a compact configuration. A number of tool blades, including a knife blade, a file, and a can opener, are pivotably mounted to fold into the handles or extend for use, as in an ordinary SWISS ARMY knife. The tools blades and the plier jaws are mounted at opposite ends of the handle.

U.S. Pat. No. 5,142,721 to Sessions et al. describes another MPT with pliers. The jaws in sessions are retractable so that the handle need not be rotated to open the tool. Like the Leatherman tool, Sessions's tool includes a number of tool blades pivotably mounted at the rear of the handle.

One serious drawback of these collapsible MPTs is that they only provide a limited, predetermined set of tools. This restricts their usefulness in many situations. For example, the MPTs described above are not well suited for performing automotive repairs, because they do not have wire strippers, wrenches, hex keys, and torx screwdrivers. As a result, those tools would have to be carried in addition to any of the prior MPTs. But because additional tools must be carried, the aforementioned benefits of MPTs can not be fully realized. Similarly, prior MPTs that do not include a fish scaler and a hook remover would not be well suited for use on a fishing trip, because additional tools would be needed.

Increasing the functionality of the MPT by providing a very wide variety of tool blades is problematic because this would cause the tool to become heavy, large, and uncomfortable. Because of these problems, prior collapsible MPTs are best suited for general or casual use—not for use in specialized applications.

Another problem with prior collapsible MPTs is the limited accessibility of the smaller tools in the MPT. In both Sessions's and Leatherman's tools, for example, the handle must be opened to obtain access to the tool blades. Then, after the desired tool blade is extended to its operating position, the handle is typically closed before the tool is used. These extra steps of opening and closing the handle can be bothersome, especially if the user is alternating among multiple tool blades.

U.S. Pat. No. 5,251,353 to Lin describes a non-collapsible MPT with pair of pliers and handles designed to accept certain tools. The end of one handle has a hex channel for receiving tool bits with hex shafts, such as screwdriver and nutdriver bits. The end of the other handle has a groove adapted to receive a blade carrier. When the blade carrier is installed in the groove, Lin's device provides the functions of grasping, screwdriving and cutting.

A problem shared by all of these prior MPTs is that the handle arrangement makes it difficult to use the tool with a tool bit perpendicular to the handle. In Leatherman and Sessions, this is because the handles face one another so that a tool blade can only be deployed extending longitudinally from the end of a handle. For certain tool blades like allen wrenches and corkscrews, however, a user may want the handle to be perpendicular to the blade for added torque. In order to accomplish this with these tools the handles must left open, which creates an awkward grasping surface. Lin's tool also does not provide for perpendicular blade extension, because the second handle would be in the way.

Another problem with prior MPTs is that the user is stuck with the particular suite of tools selected by the tool manufacturer. If a user needs a particular tool that is not available in an MPT, the user would have to carry that tool in addition to his MPT. Conversely, if a user has no need for a particular tool that is in an MPT, that tool merely adds dead weight to the MPT without providing any useful functionality.

Yet another problem with prior MPTs is that their handle configurations limit the number of smaller tools that can be provided in the MPT. For example, in each of the tools discussed above, the tool blades can only be mounted near the rear of the handle, because mounting them near the front of the handle would interfere with the plier jaws or the opposite handle.

SUMMARY OF THE INVENTION

The present invention advantageously overcomes the disadvantages of prior MPTs by providing a folding tool with a pair of cartridge receiving cavities. The user can select from a plurality of function-specific cartridges and insert the desired cartridges into the cavities. By using this system, the user has a greatly improved chance of obtaining all needed tools in a single MPT.

The present invention also advantageously allows the user to switch the suite of available tools whenever desired. For example, a person going on a fishing trip could insert a fishing tool cartridge into the MPT for a fishing trip one day, and insert a bicycle cartridge into the same MPT for a biking trip the next day. Because the cartridges should be significantly less expensive than an entire dedicated tool (if one were available at all), this arrangement is also economical.

According to one aspect of the invention, a foldable tool is provided. The tool includes a pair of pivotably connected jaws and a pair of handles. Each handle has a cavity adapted to receive a removable cartridge. The front ends of the handles are pivotably connected to tangs of the jaws so the handles can be moved between an extended position in which the handles operate the jaws, and a closed position.

According to another aspect of the invention, a foldable tool is provided. The tool includes a pair of pivotably connected jaws and a pair of handles. Each handle has a cavity adapted to receive a removable cartridge and a grasping surface. The front ends of the handles are pivotably connected to tangs of the jaws so the handles can be moved between an extended position and a closed position. In the extended position, the cavities of the handles face each other, the rear end of each of the handles and the gripping end of the jaws are disposed on opposite sides of the jaw's pivot, and each handle is engaged with a respective jaw so that the jaws can be operated. In the closed position, the rear ends of the handles and the gripping ends of the jaws are disposed on the same side of the pivot, and the grasping surfaces of the first and second handles face each other.

According to yet another aspect of the invention, a removable tool cartridge, capable of being inserted into a tool handle is provided. The cartridge includes a housing configured to fit closely within a cavity in the handle, and tool blades pivotably mounted near both the rear and the front of the housing.

According to yet another aspect of the invention, a foldable tool system including a handle unit and a removable cartridge is provided. The handle unit includes a pair of pivotably connected jaws and a pair of handles. Each handle has a cavity adapted to receive a removable cartridge. The front ends of the handles are pivotably connected to tangs of the jaws so the handles can be moved between an extended position in which the handles operate the jaws, and a closed position. The removable cartridge is adapted to fit in either cavity, and it includes tool blades pivotably mounted near at least one end of the cartridge.

DETAILED DESCRIPTION OF THE PREFERRED EMBODIMENTS

Figure 1:
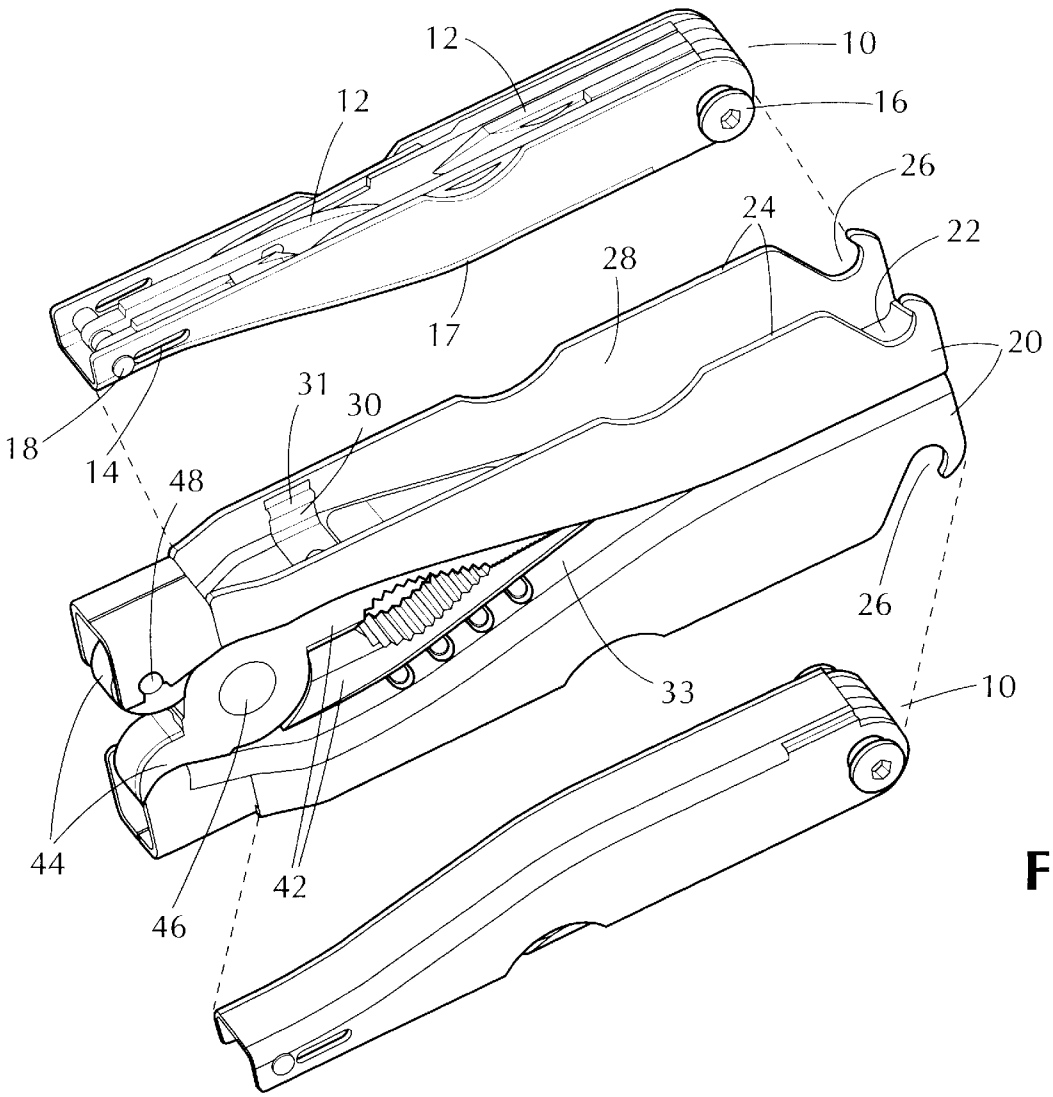
FIG. 1 is a perspective view of a tool (in the closed position) and a pair of interchangeable cartridges in accordance with a preferred embodiment of the present invention.

FIG. 1 shows a tool and a pair of cartridges 10 in accordance with the present invention. The tool includes a pair of jaws. Each jaw has a gripping end 42 and a tang 44. The jaws are pivotally connected by a pivot 46 in a conventional manner, with the pivot located between the gripping end 42 and the tang 44 of each jaw.

A pair of pivoting handles 20 are attached to the jaws in a conventional manner, with a front end of each handle 20 being attached to the respective tang 44 about a pivot pin 48, for each jaw. The handle 20 has a base 22 which extends from the front of the handle to a rear of the handle. A pair of sidewalls 24 rises up from the base 22 for each handle 20. The base 22 and the sidewalls 24 define a cavity 28 therebetween. When the handles are in the closed position, as depicted in FIG. 1, these cavities 28 are accessible from opposing sides of the tool. Each cavity 28 is shaped to accommodate a cartridge 10.

The sidewalls 24 may be directly connected to the base 22. Preferably, the sidewalls 24 and the base 22 are formed from a single piece of sheet metal. Alternatively, the sidewalls 24 may be fastened to the base 22 with an adhesive, or connected through intermediate structural members.

A pair of alignment notches 26 are cut into the sidewalls 24 at the rear of each handle 20. Preferably, these notches 26 are slanted rearward as they extend from the top of the sidewalls 24 down toward the base 22, and the ends of the notches 26 closest to the base 22 are rounded.

Each cartridge 10 has an outer shell 17 shaped to closely fit inside the cavity 28 in the handle 20. The cartridge contains one or more tool blades 12. One particular advantage of this arrangement is that it allows tool blades to be pivotably mounted about pivot pins 18 at either end of the cartridge 10 in a conventional manner, as in ordinary pocket knives.

In this embodiment, in order to reduce the bulk of the tool, the handle is tapered at its front end to accommodate the jaws when the tool is closed. As a result, less room is available at the front end of the cartridge 10. Because the tools at the front of the cartridge may be unable to extend a full 180° when the cartridge is installed in the handle 20, it is preferable to place tools that operate best when extended only approximately 90° (e.g., allen keys and corkscrews) in the front of the cartridge 10. The handle may be used to provide leverage when twisting these tools. Other tools that function with extension angles of up to 135° could also be used in this position.

Preferably, the assortment of tools within each cartridge is selected along functional lines. For example: a fisherman's cartridge could include a gutting knife, a fish scaler, a hook remover, scissors, a bottle opener, a file, assorted screwdrivers, and the like. A bicycler's cartridge could include knife blades, screwdrivers, hex keys, and wrenches, and other appropriate tools. Likewise, a golfer's cartridge could include knife blades, screwdrivers, a spike wrench, a divot tool, and a double cut saw. Numerous other specialized tool sets can be readily envisioned, including, for example, tool sets for camping, hunting, automotive repair, boating, and business traveling.

Alignment protrusions 16 near the rear portion of the cartridge 10 are sized and located to mate with the alignment notches 26 in the handle 20. Preferably, alignment protrusions 16 extend from both sides of the cartridge 10. In a less preferred embodiment, an alignment protrusion 16 extends from only one side of the cartridge, and one of the notches 26 in the handle 20 may be omitted. The alignment protrusions 16 may be integral with the pivot pin 18 that passes through the tool blades 12 near the rear of the cartridge. Alternatively, separate alignment protrusions, not integral to the pivot pin, can be used.

To insert a cartridge 10 into the one of the handles 20, the alignment protrusions 16 at the rear end of the cartridge 10 are guided into the alignment notches 26 in the handle 20. Then, the front end of the cartridge is pressed down into the cavity 28 in the handle 20. The same procedure is used to insert the other cartridge 10 into the other handle 20.

Various means for holding the cartridge 10 in place inside the handle 20 may be used. One such means is depicted in FIG. 1. A leaf spring 30 is located near the front of the handle 20, inside the cavity 28. This leaf spring 30 has a convex portion 31 that presses against the cartridge 10 when the cartridge is inserted into the handle 20. A similar convex portion at the second end of the leaf spring (not shown) presses against the other side of the cartridge 10.

The sidewalls of the cartridge 10 can contain depressions 14 shaped to mate with the convex portions 31 of the leaf spring 30. When the front end of the cartridge 10 is pressed down into the channel 28 during the cartridge installation process, described above, the convex portions 31 of the leaf spring 30 will snap into the depressions 14 in the cartridge. The spring action of the leaf spring 30 against the cartridge sidewall will secure the front of the cartridge 10, while the alignment protrusions 16 at the rear of the cartridge 10 is secured by the alignment notches 26.

Of course, alternative methods may be used to secure the cartridge in the handle. For example, the leaf spring 30 in the handle and the notch 14 in the cartridge may be replaced with a spring-mounted ball (not shown) in the sidewall 24 and a corresponding dimple (not shown) in the cartridge. Numerous other alternative hold-down approaches can be readily envisioned.

Figure 2:
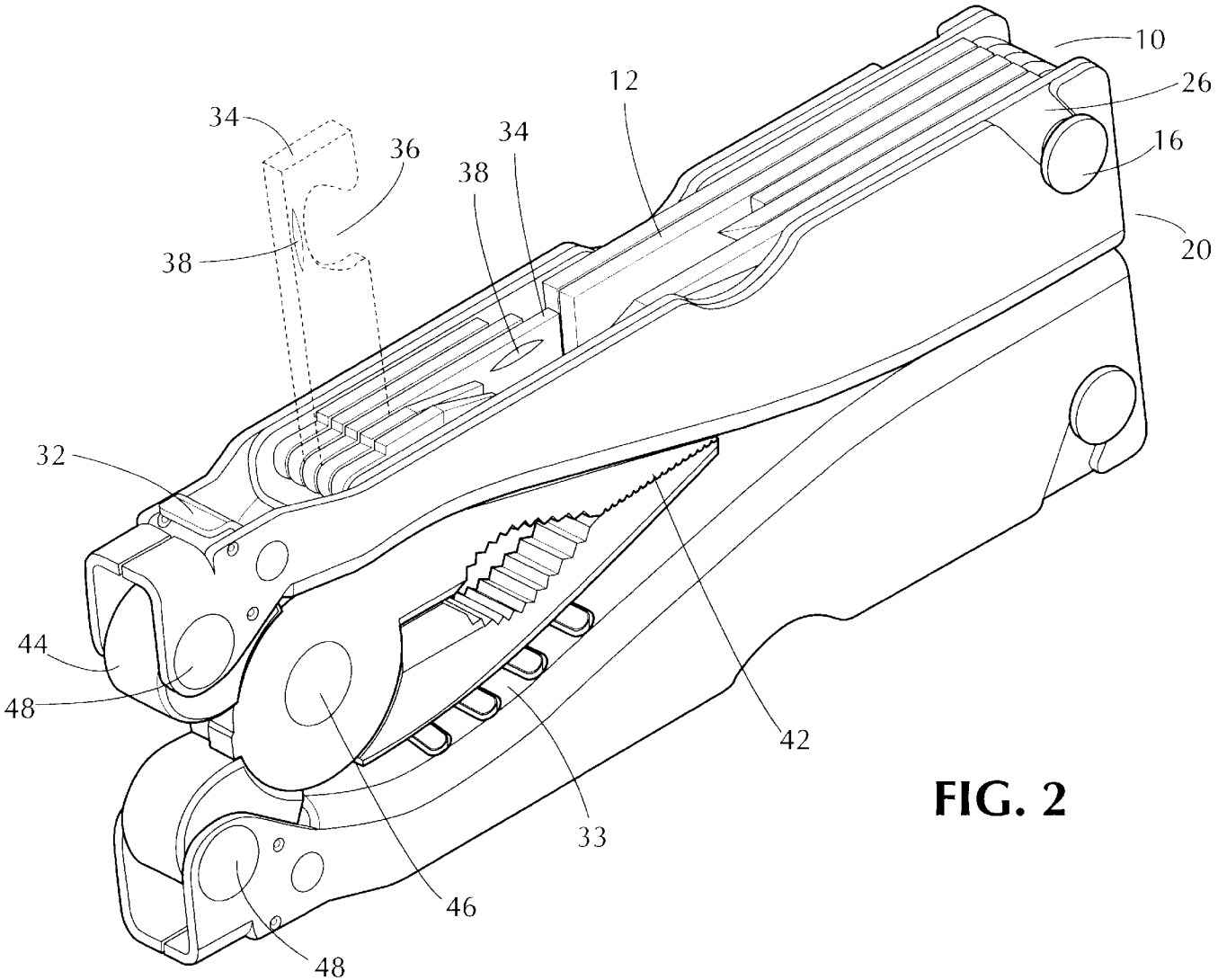
FIG. 2 is a perspective view of the tool in the closed position, with the cartridges installed.

FIG. 2 depicts the tool after the cartridges 10 have been installed in the handle 20 in this manner. Once the cartridges 10 have been installed, the tool blades 12 may be pivoted into position for use by grasping the edges of the tool blades 12 and pulling them up, away from the handle, in a conventional manner. After being used, the tool blades may be returned to their stowed position inside the cartridge, also in a conventional manner.

This configuration provides a number of advantages over the prior art. In particular, because the tool blades are accessible when the tool is folded, the handles need not be opened to access and use the tool blades. In addition, because the tool blades flip outward when the handles are closed, the tool blades can be used when they are perpendicular to the handle. This is particularly advantageous for certain tool blades including allen wrenches and corkscrews, where the handle can be used to provide additional torque. Yet another advantage of this configuration is that a larger number of tool blades can be provided, because tool blades can be mounted on both the front and rear ends of the tool.

Figure 3:
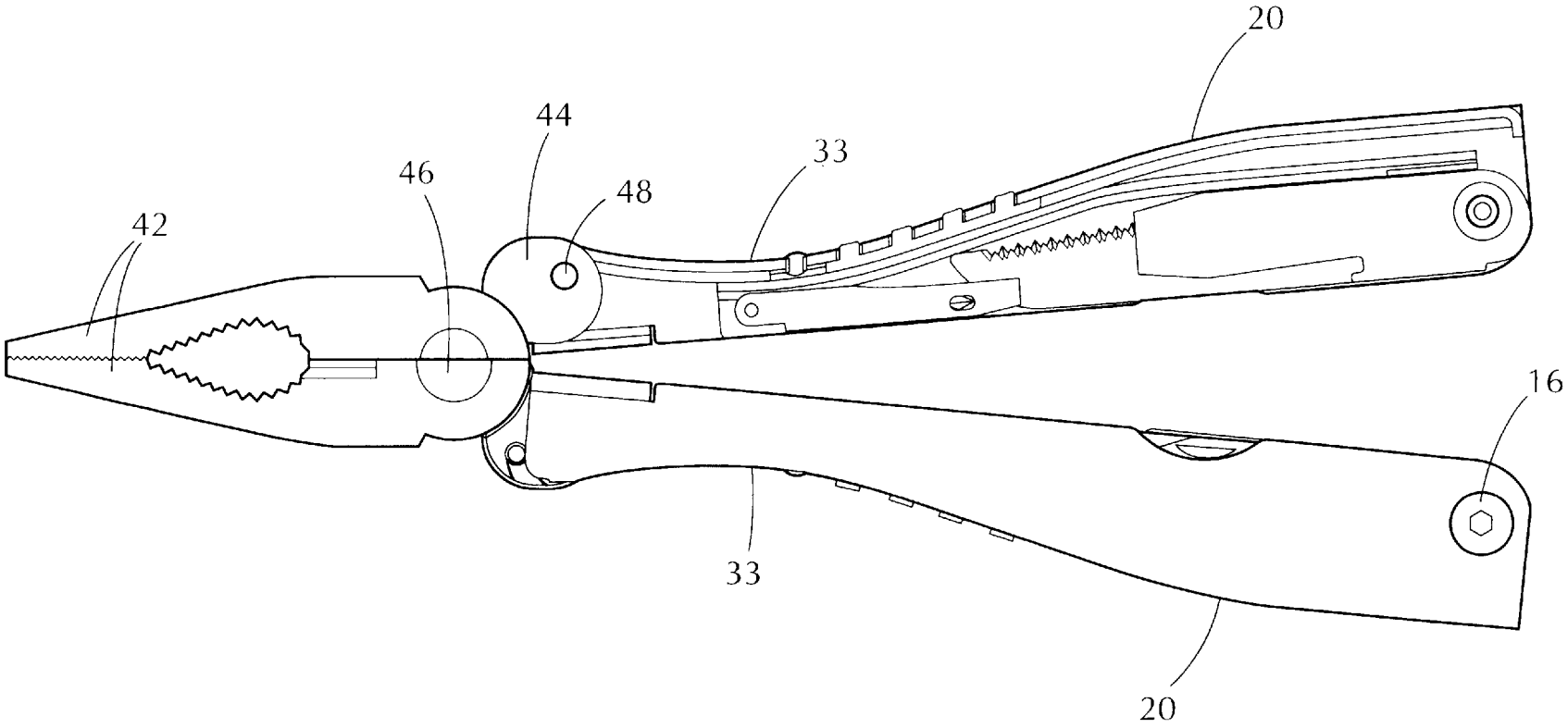
FIG. 3 is a side view of the tool in the open position, with the cartridges installed. One handle is shown in a sectional view.

To use the jaws as pliers, the user must first open the tool. This is accomplished by grasping the handles 20 and moving them away from each other. The handles 20 will begin to rotate about the pivot pins 48. The user continues to rotate the handles 20 about the pivot pins 48 until they reach the position depicted in FIG. 3. At this point, the tool is open and ready to be used as pliers.

In this position, the cartridges and their tool blades are stowed inside the handles 20, and the outer surfaces of the bases 22 (shown in FIG. 1) provide smooth grasping surfaces 33 which can be comfortably grasped by a user. When the user squeezes the handles 20 together, the handles urge the tangs 44 together. This causes the gripping ends 42 of the jaws to be forced together. Similarly, when the handles are moved apart, the gripping ends 42 will be pulled apart (as with an ordinary pair of pliers). The handles and the tangs may be engaged with each other in a manner conventional for folding tools.

When the user is finished using the pliers, the tool can be refolded by forcing the handles 20 away from each other and rotating them back to their closed position, as depicted in FIG. 2.

The tool also includes means for removing cartridges that have been previously inserted into one of the handles. These means may be incorporated into the handle or, alteratively, into the cartridges. FIG. 2 depicts two suitable examples.

One example of a cartridge mounted removing means is the cartridge removal blade 34. This blade 34 ordinarily lies flat within the cartridge 10, together with the other tool blades 12. To remove the cartridge, the user first lifts up the cartridge removal blade 34 into the upright position depicted by the dashed lines. Finger notch 38 makes the blade 34 easier to grasp. Once the cartridge removal blade 34 has been raised to its upright position, a finger can be inserted into the notch 36 in the cartridge removal blade 34. The user then pulls the cartridge removal blade 34 away from the handle 20, pulling the cartridge 10 out of the cavity in the handle 20. The cartridge removal blade 34 must be pulled up with sufficient force to release any cartridge holding means being used to hold the cartridge in place.

Figure 4:
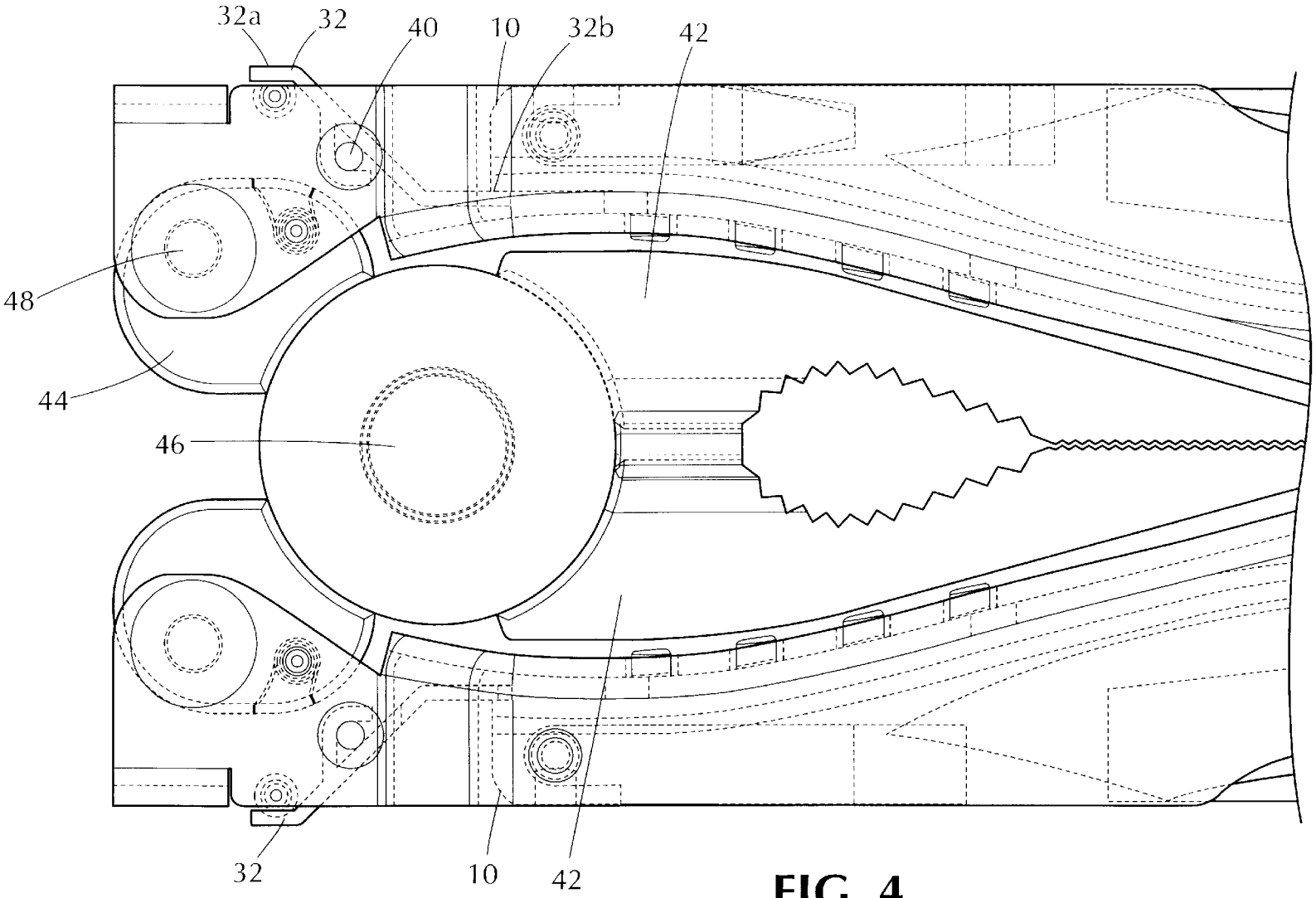
FIG. 4 is a detailed sectional side view of the tool in the closed position, depicting a cartridge removal system.

Lever 32, shown in more detail in FIG. 4, is one example of a handle-mounted removing means. The user can eject a cartridge 10 from the handle 20 by pressing on the lever 32. Of course, while FIG. 2 depicts both a cartridge removal lever 32 and a cartridge removal blade 34, only one of these need be included in the tool to facilitate cartridge removal.

FIG. 4 depicts a detailed view of the cartridge removal lever 32. The lever 32 pivots about a pivot pin 40. When the cartridge 10 is installed in the handle 20, as depicted, the rear end 32*b* of the lever will be seated in the bottom of the cavity in the handle 20 beneath the cartridge 10. To remove the cartridge, the user presses down on the front end 32*a* of the lever 32. This causes the lever 32 to rotate about the pivot pin 40, forcing the rear end 32*b* of the lever 32 up, which pushes the front end of the cartridge 10 out of the cavity. The lever 32 must be operated with sufficient force to release any cartridge holding means being used to hold the cartridge in place. Once the front of the cartridge 10 has been pushed out of the cavity and the cartridge holding means has been released, the user simply lifts the front end of the cartridge and pulls the cartridge out.

Of course it will be appreciated that numerous alternative cartridge removal mechanisms may be substituted for those described above, as will be appreciated by those skilled in the art.

Figure 5:
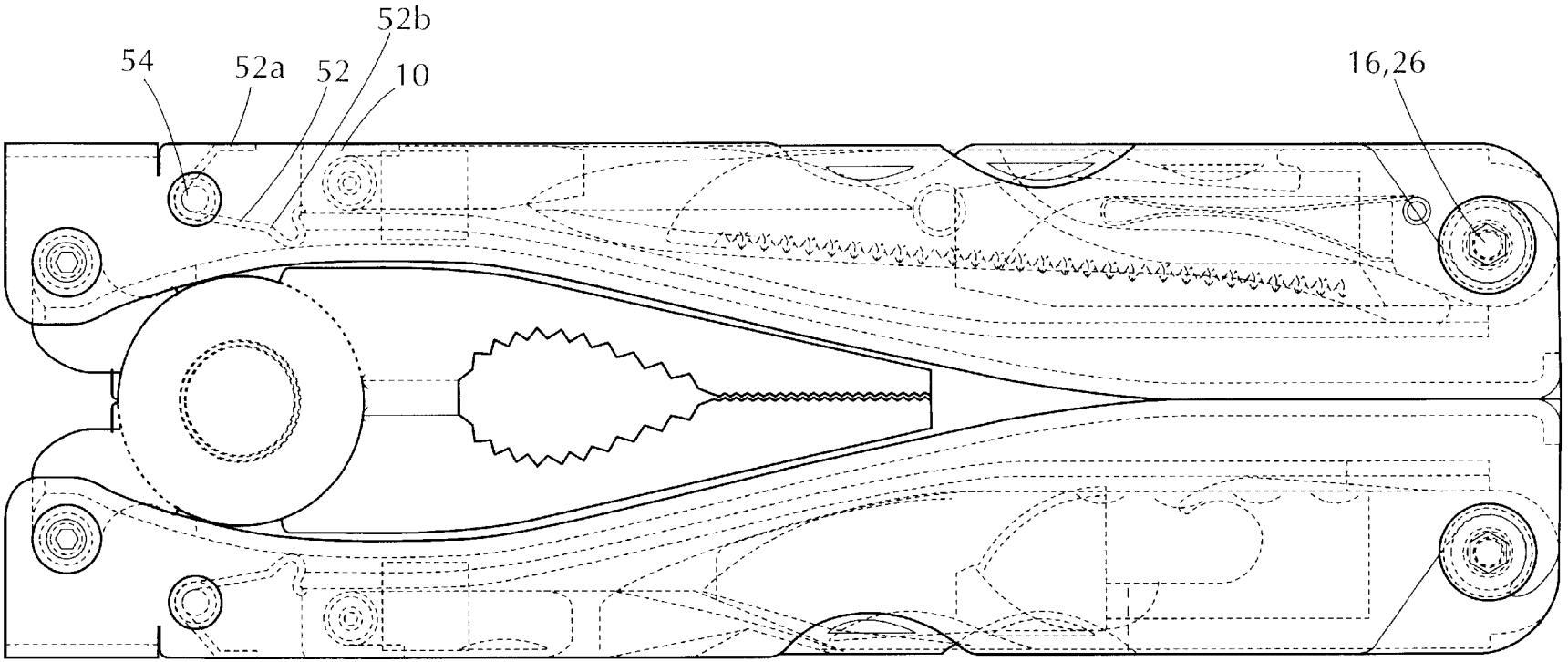
FIG. 5 is a sectional side view of another preferred embodiment of the tool in the closed position.

FIG. 5 is a side view of another embodiment of the tool in the closed position. In this embodiment, a single spring performs the two functions of holding and removing the cartridge. Preferably, the spring 52 is almost as wide as the cartridge (e.g., approx. ¾ of the width of the cartridge). The spring 52 is mounted in the handle so that it can rotate about a pivot pin 54, which could be, for example, a rivet. When the cartridge 10 is pressed into the cavity in the handle 20, the bottom arm 52*b* of the spring 52 is compressed between the front end of the cartridge 10 and the pivot pin 54. Because the pivot pin 54 is higher than the point of contact between the bottom arm 52*b* and the cartridge 10 when the cartridge is fully inserted into the cavity, the spring action will press the front of the cartridge 10 down into the cavity. It will also press the cartridge 10 rearward, urging the alignment protrusions 16 of the cartridge into the alignment notches 26 in the handle, which will hold the cartridge in place at the rear.

To remove the cartridge, the user pulls up on the top flange 52*a* of the spring 52. This causes the entire spring to rotate about the pivot pin 54, moving the bottom arm 52*b* out of the cavity, which pushes the front of the cartridge 10 out of the cavity. This causes the cartridge 10 to rotate about the alignment protrusions 16, which are held in place by the alignment notches 26. When the cartridge 10 has rotated far enough, the cartridge 10 is released and can be easily removed. Preferably, a conventional biasing means is provided (not shown) to hold the spring in the raised position until another cartridge is pushed in.

Of course it will be appreciated that numerous alternative combination holding/removal mechanisms may be substituted for those described above, as will be appreciated by those skilled in the art.

While the present invention has been described above with reference to the specific embodiments, it is to be understood that the invention is not limited to those precise embodiments. For example, the present invention could be implemented with a pair of scissors, shears, snips, wire cutters, or other implement in place of the pliers described above. This could be accomplished by simply replacing the gripping end of each jaw with an appropriate operating end (e.g., a scissors blade) . These and other changes and modifications can be effected without departing from the scope or spirit of the present invention.

We claim:

1. A foldable tool comprising:

first and second jaws, each of said jaws having an operating end and a tang end, said jaws pivotably connected to each other intermediate the operating end and the tang end of each jaw; and first and second handles, each of said handles having a front end and a rear end, and a cavity adapted to receive a removable cartridge, wherein the front end of each of said handles is pivotably connected to a respective one of said tangs so as to enable the handles to be moved between (1) an extended position in which each handle is engaged with a respective jaw so that the jaws will close when the handles are moved toward each other and will open when the handles are moved apart, and (2) a closed position.

2. The foldable tool according to claim 1, wherein each handle includes means for removing the cartridge from the cavity.

3. The foldable tool according to claim 1, wherein each handle includes means for holding the cartridge inside the cavity.

4. The foldable tool according to claim 1, wherein each cavity is deeper at the rear end of the handle than at the front end of the handle.

5. The foldable tool according to claim 1, wherein each of said handles includes a leaf spring having a convex region for mating with a corresponding depression in the cartridge, so that when a cartridge is installed, spring action will urge the leaf spring against the depression in the cartridge.

6. The foldable tool according to claim 1, wherein each of said handles includes a lever, and a first end of the lever is located between the cartridge and a floor of the cavity when the cartridge is installed in the handle, so that when the second end of the lever is moved, the first end of the lever moves away from the cavity floor and pushes against the cartridge.

7. The foldable tool according to claim 1, wherein each of said handles includes a leaf spring having a top flange and a bottom arm, the leaf spring mounted to allow rotation about a spring pivot located between the top flange and the bottom arm, so that the bottom arm will engage the cartridge and be compressed between the cartridge and the spring pivot when the cartridge is installed in either of said handles, and that the bottom arm is lifted out of the cavity by movement of the top flange.

8. The foldable tool according to claim 1, wherein each handle has at least one sidewall having an alignment notch for receiving an alignment protrusion of the cartridge.

9. The foldable tool according to claim 8, wherein the alignment notch is located near the rear of the handle, and the alignment notch has an open end and a rounded closed end with the rounded closed end located closer to the rear of the handle than the open end.

10. The foldable tool according to claim 1, wherein each of said handles includes means for removing the cartridge from the cavity and means for holding the cartridge inside the cavity, and at least one sidewall having an alignment notch for receiving an alignment protrusion of the cartridge.

11. A foldable tool comprising:

first and second jaws, each of said jaws having an operating end and a tang end, said jaws pivotably connected to each other about a pivot located between the operating end and the tang end of each jaw; and first and second handles, each of said handles having a base and a pair of sidewalls running in a front-to-rear direction, inner surfaces of the base and the sidewalls defining a cavity therebetween, each of the cavities being adapted to receive a removable cartridge, an outer surface of the base providing a grasping surface, a front end of each of said handles being pivotably connected to a respective one of said tangs so as to enable the handles to be moved between (1) an extended position in which the cavities of the first and second handles face each other, a rear end of each of said handles and the operating end of said jaws are disposed on opposite sides of the pivot, and each handle is engaged with a respective jaw so that the jaws will close when the handles are moved toward each other and will open when the handles are moved apart, and (2) a closed position in which the rear end of each of said handles and the operating ends of said jaws are disposed on a same side of the pivot, and the grasping surfaces of the first and second handles face each other.

12. The foldable tool according to claim 11, wherein each handle includes means for removing the cartridge from the cavity.

13. The foldable tool according to claim 11, wherein each handle includes means for holding the cartridge inside the cavity.

14. The foldable tool according to claim 11, wherein each cavity is deeper at the rear end of the handle than at the front end of the handle.

15. The foldable tool according to claim 11, wherein each of said handles includes a leaf spring having a convex region for mating with a corresponding depression in the cartridge, so that when the cartridge is installed, spring action will urge the leaf spring against the depression in the cartridge.

16. The foldable tool according to claim 11, wherein each of said handles includes a lever, and a first end of the lever is located between the cartridge and a floor of the cavity when the cartridge is installed in the handle, so that when the second end of the lever is moved, the first end of the lever moves away from the cavity floor and pushes against the cartridge.

17. The foldable tool according to claim 11, wherein each of said handles includes a leaf spring having a top flange and a bottom arm, the leaf spring mounted to allow rotation about a spring pivot located between the top flange and the bottom arm, so that the bottom arm will engage the cartridge and be compressed between the cartridge and the spring pivot when the cartridge is installed in a handle, and that the bottom arm is lifted out of the cavity by movement of the top flange.

18. The foldable tool according to claim 11, wherein at least one of the sidewalls of each handle has an alignment notch for receiving an alignment protrusion of the cartridge.

19. The foldable tool according to claim 18, wherein the alignment notch is located near the rear of the handle, and the alignment notch has an open end and a rounded closed end with the rounded closed end located closer to the rear of the handle than the open end.

20. The foldable tool according to claim 11, wherein each of said handles includes means for removing the cartridge from the cavity and means for holding the cartridge inside the cavity, and at least one of the sidewalls of each of said handles has an alignment notch for receiving an alignment protrusion of the cartridge.

21. A foldable tool system comprising:

(i) a handle unit including (a) first and second jaws, each of said jaws having an operating end and a tang end, said jaws being pivotably connected to each other intermediate the operating end and the tang end of each jaw; and (b) first and second handles, each of said handles having a front end and a rear end, and a cavity, the front end of each of said handles being pivotably connected to a respective tang end so as to enable the handles to be moved between (1) an extended position in which each handle is engaged with a respective jaw so that the jaws will close when the handles are moved toward each other and will open when the handles are moved apart, and (2) a closed position; and (ii) a removable cartridge adapted to fit in at least one of the cavities, the cartridge including at least one tool blade pivotably mounted near a first end of said cartridge to enable movement between a stowed position inside the cartridge and an extended position.

22. The foldable tool system according to claim 21, further comprising a second removable cartridge adapted to fit in either cavity, wherein the second cartridge includes at least one tool blade pivotably mounted near a first end of said second cartridge to enable movement between a stowed position inside the second cartridge and an extended position.

23. The foldable tool system according to claim 21, wherein the cartridge includes at least one tool blade pivotably mounted near a second end of said cartridge to enable movement between a stowed position inside the cartridge and an extended position.

24. The foldable tool system according to claim 21, wherein each cartridge contains an assortment of tool blades for performing related functions.

25. The foldable tool system according to claim 21, wherein each cartridge includes means for removing the cartridge from the cavity.

26. The foldable tool system according to claim 21, wherein each handle includes means for removing the cartridge from the cavity.

27. The foldable tool system according to claim 21, wherein each handle includes means for holding the cartridge inside the cavity.

28. The foldable tool system according to claim 21, wherein each cartridge and each cavity is deeper at a rear end than at a front end.

29. The foldable tool according to claim 21, wherein the at least one tool blade is designed to be operated with an extension angle, measured from the stowed position, of less than about 135°.

30. The foldable tool according to claim 21, wherein the at least one tool blade is designed to be operated with an extension angle, measured with respect to the handle, of about 90°.

* * * * *